United States Patent [19]

Lewy

[11] Patent Number: 4,882,019

[45] Date of Patent: Nov. 21, 1989

[54] APPARATUS AND METHOD FOR POLISHING A PLUMBING OR ELECTRICAL FIXTURE

[76] Inventor: Michael M. Lewy, R.D. #1, Priddle Point, Gloversville, N.Y. 12078

[21] Appl. No.: 274,005

[22] Filed: Nov. 21, 1988

[51] Int. Cl.[4] ..... C25F 3/16; C25F 7/00

[52] U.S. Cl. ..... 204/129.1; 204/141.5; 204/224 M; 204/212; 204/271

[58] Field of Search ..... 204/129.1, 141.5, 224 M, 204/271, 212

[56] References Cited

U.S. PATENT DOCUMENTS

| | | | |
|---|---|---|---|
| Re. 26,039 | 6/1966 | Johnson | 51/392 |
| 2,848,410 | 8/1958 | Knuth-Winter Feldt et al. | 204/224 M |
| 4,016,394 | 4/1977 | Hecht et al. | 219/61 |
| 4,224,123 | 9/1980 | McLain | 204/212 X |
| 4,270,986 | 6/1981 | Smith | 204/141.5 X |
| 4,431,501 | 2/1984 | Leppanen | 204/271 X |
| 4,495,045 | 1/1985 | Jackson | 204/271 X |
| 4,801,367 | 6/1989 | Burgess et al. | 204/224 M |

FOREIGN PATENT DOCUMENTS

| | | | |
|---|---|---|---|
| 0085899 | 5/1984 | Japan | 204/129.1 |

OTHER PUBLICATIONS

"Surface Treatments-Electropolishing", by John F. Jumer, Jan. 1988 Metal Finishing Guidebook Directory, pp. 420-428.

"Electro Glo 200 Electropolishing Concentrate for Copper and Copper Alloys", Electro-Glo Technical Bulletin, pp. 1-4.

"Introducing the new Port-A-Weld Machine", Wheeler Industries product advertisement.

Die Rohr-Gripzange by Bessey of West Germany product advertisement.

*Primary Examiner*—Donald R. Valentine

*Attorney, Agent, or Firm*—Heslin & Rothenberg

[57] ABSTRACT

An apparatus and method for polishing a metallic plumbing or electrical fixture, such as a pipe, pipe fitting or electrical bus bar, is provided. The apparatus includes container means for retaining an electrolytic solution and a cathode member. The member is specially designed to accommodate a plumbing fixture having a circular cross-section or an elongate electrical fixture, and is at least partially immersed within the solution. The apparatus also includes dc power supply means having a negative terminal, which is connected to the cathode member, and a positive terminal which is connected to a clamp means. The clamp means is capable of forming an electrical connection with the fixture to be polished. When the clamp means is secured to the fixture and the fixture is positioned near the cathode member, polishing of the fixture occurs. In an enhanced embodiment, the cathode member includes a first column which extends above the electrolytic solution and which is surrounded by a wicking material capable of drawing the solution from the container means to the free end of the column such that a fixture does not have to be immersed within the electrolytic solution to be polished. A related method for polishing a plumbing fixture having a circular cross-section or an elongate electrical fixture is also provided.

24 Claims, 3 Drawing Sheets

APPARATUS AND METHOD FOR POLISHING A PLUMBING OR ELECTRICAL FIXTURE

BACKGROUND OF THE INVENTION

1. Technical Field

Principally, the present invention relates to the preparation of metallic plumbing fixtures, namely a pipe and pipe fitting, (herein referred to as "fitting") for solder jointing, and more particularly to an apparatus and method for quickly and efficiently polishing the telescoping surfaces of a pipe and fitting preparatory to their being united in a solder joint.

2. Description of the Prior Art

Most residential and commercial plumbing installations consist of copper or copper alloy tubings and fittings soldered together, as do many heating systems. Preparatory to soldering, all oxide, grease, dirt and other debris on the inside and outside mating surfaces of a pipe and fitting must be removed and the mating surfaces must be smoothed in order to facilitate complete solder flow about the union, to thereby reduce the possibility of subsequent leaks.

Present techinques for preparing the telescoping surfaces of a pipe and fitting for soldering require an inordinate amount of time and effort to carry out. Specifically, two polishing methods now dominate the art. The first method is simply to use emery paper and/or a stiff steel brush to manually polish the outside and inside mating surfaces of a pipe and fitting, respectively. In addition to the obvious time consuming nature of this approach, the small size, and sometimes the shape, of the pipe or fitting to be polished often results in an unsatisfactory cleaning of the appropriate mating surfaces.

The second commonly used approach essentially comprises an electrical version of the manual cleaning method. Namely, a belt sander is used to polish the outside surface of the pipe and a series of oscillating steel brushes are employed to polish the inside surface of the fitting. Although clearly an improvement over the conventional manual polishing method, this approach still requires a great deal of time and individual attention to detail to carry out for a single pipe and fitting combination to be united.

Significant to proper electrical installation, is the related action of cleaning oxides from an electrical bus bar prior to installation. Most residential and commercial electrical entrances today utilize at least one electrical bus bar, e.g., as a central ground and/or neutral connection, which must be cleaned of all oxides and debris. This is to ensure proper electrical connection of wires to the bar. An electrical bus bar, which typically ranges from 1 foot to 4 feet in length, is also normally cleaned via one of the two above described labor intensive techniques.

Thus, a new method and apparatus for polishing a metallic pipe and fitting preparatory to their being united in a solder joint, and for preparing a bus bar to facilitate good electrical connection thereto, in a more efficient and economical manner than heretofore known techniques are clearly desirable.

SUMMARY OF THE INVENTION

Briefly, the present invention comprises in one principal aspect an apparatus for polishing a metallic plumbing fixture having a circular cross-section and an elongate metallic electrical fixture which includes container means for retaining an electrolytic solution and a cathode member which is positionable therein. The cathode member is at least partially immersed within the electrolytic solution retained within the container means when the member is positioned within the container means. The cathode member is specially designed to accommodate a plumbing fixture have a circular cross-section and an elongate electrical fixture. The apparatus also includes dc power supply means having a negative terminal, which is electrically connectable to the cathode member, and a positive terminal, which is electrically connected to a clamp means. The clamp means is capable of forming an electrical connection with the fixture to be polished. When the cathode member is electrically connected to the negative terminal of the power supply means and the clamp means is secured about the fixture, the fixture undergoes electropolishing when brought near the cathode member.

In a further embodiment, the cathode member has a base portion and a first column extending therefrom. The first column is sized such that its free end extends above the electrolytic solution when the cathode member is positioned within the container means. This apparatus also includes wick means surrounding the first column which is capable of drawing the electrolytic solution retained within the container means to the free end of the first column and thereby facilitate polishing of the fixture.

In another aspect, the invention comprises a method for polishing a metallic plumbing or electrical fixture which includes the steps of: providing an electrochemically inert container with an electrolytic solution therein and a cathode member at least partially immersed within the solution, the cathode member has at least one column specially configured for receiving circular-shaped and elongate fixtures; providing dc power supply means having a negative terminal and a positive terminal; electrically connecting the negative terminal of the power supply means to the cathode member; electrically clamping the positive terminal of the power supply means to the metallic plumbing fixture having a circular cross-section or the elongate electrical fixture; and moving the fixture to a position near the cathode member such that the fixture is electropolished.

Accordingly, a principal object of the present invention is to provide an improved apparatus and method for quickly, efficiently and safely polishing a surface of a plumbing fixture having a circular cross-section and an elongate electrical bus bar.

Another object of the present invention is to provide such an apparatus and method which consistently and completely cleans the mating surfaces of a pipe and fitting to be united in a soldered joint.

BRIEF DESCRIPTION OF THE DRAWINGS

These and other objects, advantages and features of the present invention will be more readily understood from the following detailed description of one preferred invention embodiment when considered in conjunction with the accompanying drawings in which.

DETAILED DESCRIPTION OF THE INVENTION

Figure 1:
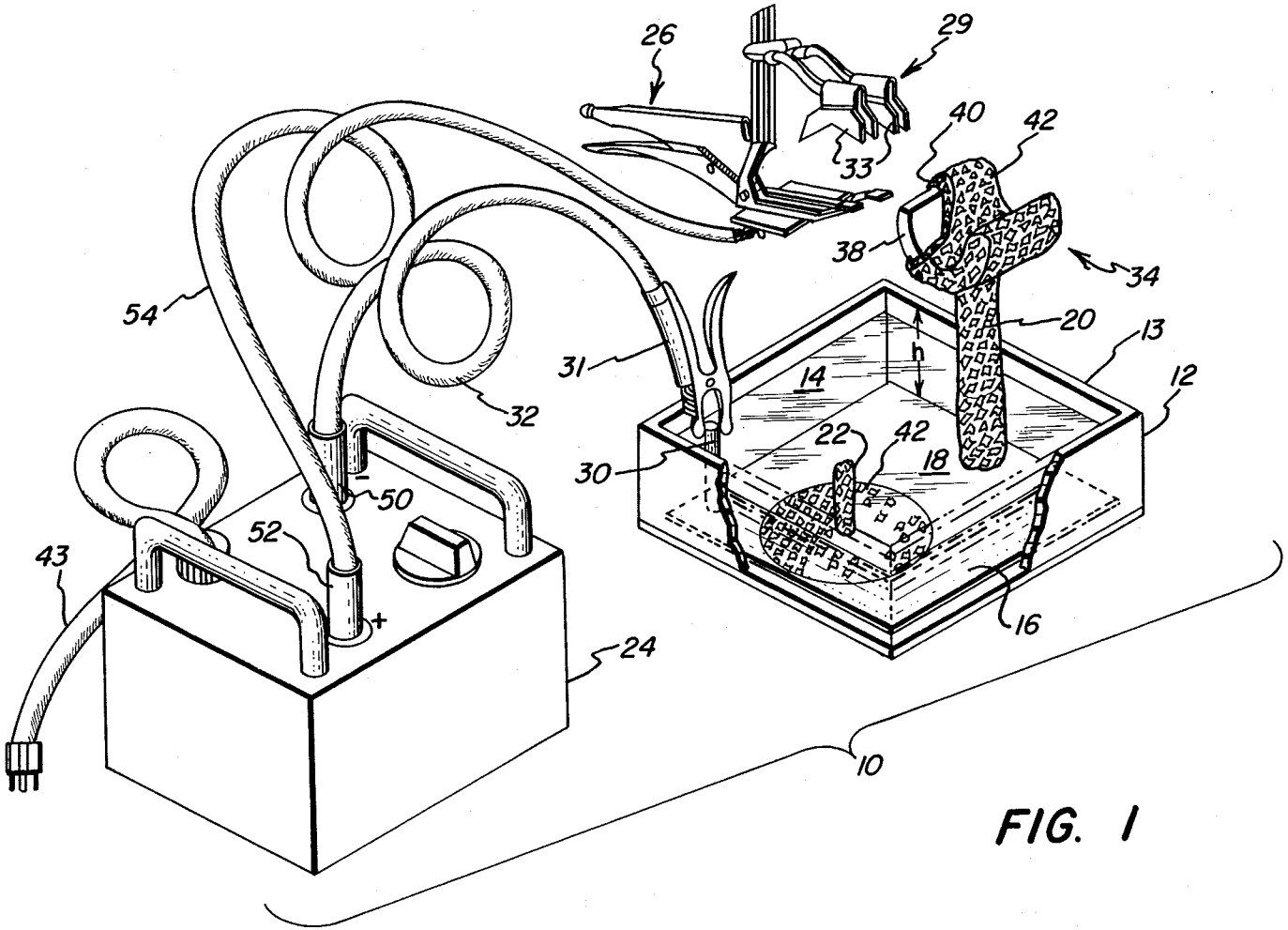
FIG. 1 is a partially cut-away perspective view of one embodiment of the apparatus of the present invention.

One detailed embodiment of the polishing apparatus of the present invention, generally denoted 10, will initially be described with reference to FIG. 1. As illustrated, apparatus 10 includes a container 12 for retaining an electrolytic solution 14. A cathode member 16 is positioned within container 12 and partially immersed within solution 14. Member 16 has a base portion 18 and first and second columns 20 and 22, respectively, extending therefrom. Apparatus 10 also includes a power supply 24 and a clamp 26 electrically connected thereto. Each of these elements is described in detail below.

Container 12, molded of an electrochemically inert material such as polyethelene, comprises an approximately 12 inch by 12 inch square nonporous receptacle for retaining electrolytic solution 14. Container 12 has at least one sidewall 13 of a height "h", which preferably measures at least several inches. Solution 14 consists of any commercially available electrolytic substance in solution known to react with the particular metal to be polished. For example several such solutions are set forth for various alloys in an article entitled "Surface Treatments—Electropolishing" by John F. Jumer which appears at pp. 420–428 in the Jan. 1988 Metal Finishing Guidebook Directory published by Metals and Plastics Publications, Inc. of Hackensack, N.J. The Jumer article is hereby incorporated herein. Approximately three quarts of electrolytic solution 14 are retained within container 12 for operation of apparatus 10. The solution is believed to have a virtually unlimited life and needs only to be replaced as the result of "drag out", as explained further below, and occasionally filtered to remove debris.

One preferred solution 14 for cleaning copper oxide and other debris from copper pipes, fittings or electrical bus bars is a mixture of 75% phosphoric acid and 25% "Electro-GLO 200", a commercially available substance marketed by Electro-Glo Company of Chicago, Ill. In addition to being safe to handle and providing improved polishing characteristics, this particular mixture appears to have beneficial properties which inhibit reoxidation. However, any known electrolyte may be utilized without departing from the scope of the present invention as defined by the appended claims. Although the apparatus and method of the present invention are principally intended for in field use, they are also clearly applicable to factory use subsequent the initial manufacture of a plumbing or electrical fixture, in which case addition to solution 14 of any known reoxidation inhibitor would be particularly beneficial.

For ease of apparatus cleaning and transportation, cathode member 16 is preferably designed to removably rest within container 12, however, securement of member 16 to container 12 is also possible if desired. In the embodiment illustrated, base 18, first column 20 and second column 22 are unitary and are manufactured of lead or a lead alloy. Base 18 comprises an approximately 11 inch by 11 inch substantially flat plate. Member 16 is electrically connected at peg 30 to power supply 24 via a gripper 31 and line 32. Peg 30 may comprise a bolt and nut secured to member 16 through base 18, but is preferably unitary with base 18. As described below, gripper 31 must be capable of handling the current flow through apparatus 10. If desired, gripper 31 could be omitted, in which case line 32 would be directly bolted to peg 30, preferably with the use of washers to enhance electrical connection of line 32 to the peg.

As shown, first column 20 has a free end 34 which extends above the at least one sidewall 13 of container 12. Free end 34 of first column 20 has a saddle-shaped configuration specially designed to receive a tubular or elongate fixture, such as pipe 35 (see FIG. 2), the exterior surface of which is to be cleaned. It is believed desirable to size saddle-shaped free end 34 to accomodate fixtures up to 4½ inches outside diameter.

As already mentioned, first column 20 preferably has a lead core, which is denoted 38 in FIG. 1. A wicking material 40 surrounds lead core 38 and functions to draw electrolytic solution 14 from container 12 to the free end 34 of column 20. Any material suitable to accomplish this function may be utilized, for example, polyester or cotton. An outer protective netting 42 surrounds both first column 20 and second column 22 to prevent a fixture from directly contacting the cathode member, and to protect wicking material 40 of column 20. Preferably, because of its strength and own wicking properties, netting 42 is manufactured of an arimide fiber material such as that produced by Dupont of Wilmington, Del. and marketed under the name Nomex. If a number of fixtures are being polished in a short period of time at free end 34 of column 20, e.g., within a minute or less, then a small pump assembly (not shown) could be added to move electrolytic solution 14 from container 12 to free end 34 through a small tube (not shown).

Figure 2:
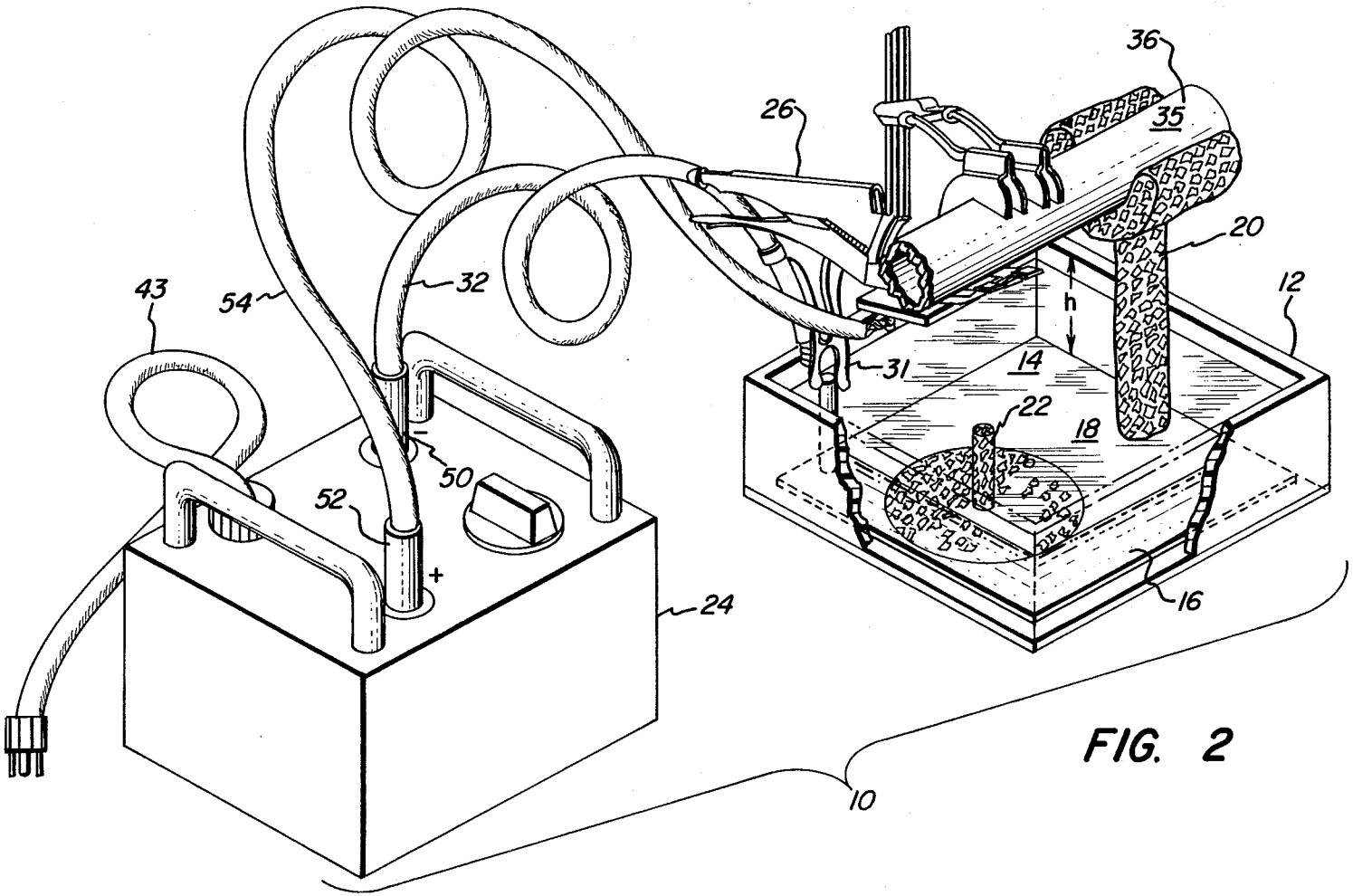
FIG. 2 is a partially cut-away perspective view of the apparatus shown in FIG. 1 with a portion of pipe positioned for polishing.

As depicted in FIG. 2, the saddle-shaped configuration of end 34 is preferably oriented such that pipe 35 is substantially horizontal when being cleaned. This is an important feature of the invention in that long lengths of pipe, e.g., 10 to 20 feet, can be readily polished without having to be angled or positioned vertically for immersion within electrolytic solution 14 retained by container 12, meaning apparatus 10 is usable for such lengths of pipe within a vertically enclosed space, such as in a roof of a house.

Figure 3:
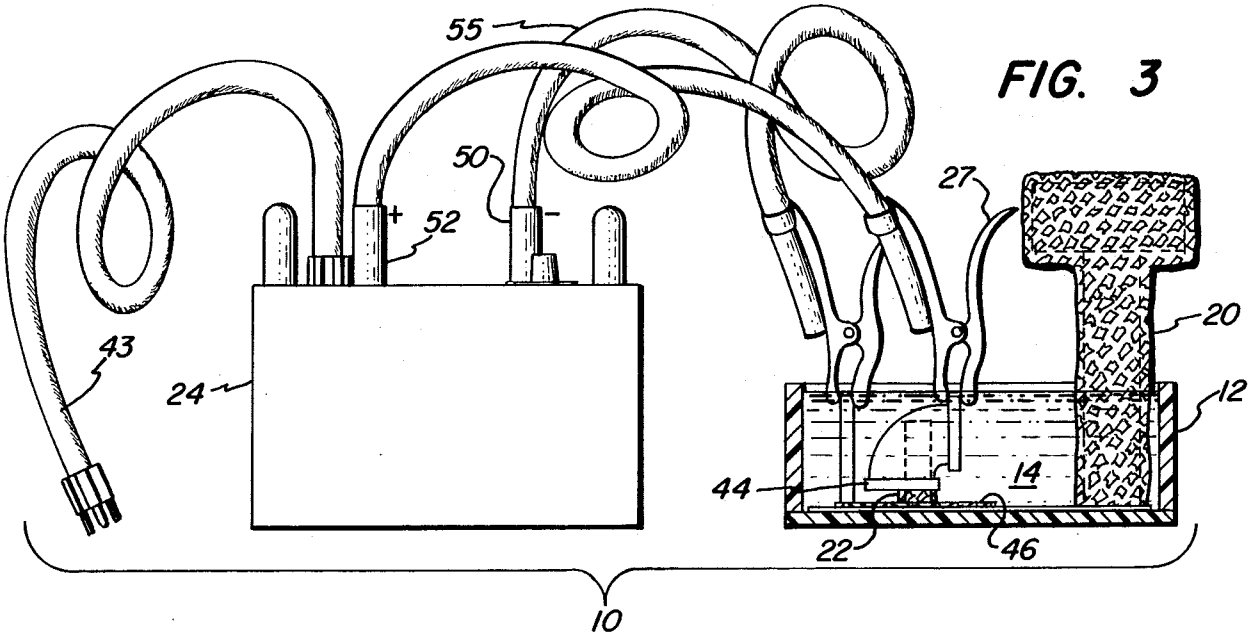
FIG. 3 is a partially cut-away side elevational view of the apparatus of the present invention shown with a fitting positioned for polishing.

Referring to FIG. 3, second column 22 of cathode member 16 is shown completely immersed within solution 14 retained by container 12. Second column 22 is primarily sized for cleaning the inner surface of tubular plumbing fittings, however, manageable lengths of pipe or bus bar, e.g., lengths up to 4 feet, could also be cleaned adjacent column 22 if desired. Should apparatus 10 only be used for cleaning pipes or electrical bus bars, then second column 22 can be omitted. A circular pad 46 of netting material 42 is provided surrounding the base of second column 22 to guard against direct copper fitting to cathode member 16 contact at base 18.

Although ac electrochemical polishing is believed possible, and the appended claims are intended to encompass such an embodiment, a dc power supply 24 is deemed preferable for cleaning the primarily copper or copper alloy pipes, fittings, and electrica1 bus bars to which the present invention is directed. Power supply 24 can comprise any commercially available dc supply means. One preferred supply is manufactured by Wheeler Industries, Ltd. of San Diego, Calif. and marketed under the trademark "Port-A-Weld". This power supply operates from a 120 volt ac 20 amp standard wall outlet via a plug 43. After rectification, it provides 10–100 amps of low voltage dc power across a negative terminal 50 and a positive terminal 52. As illustrated, negative terminal 50 is connected to cathode member 16 via line 32 and gripper 31. In FIGS. 1 and 2, positive terminal 52 is connected via line 54 to electrical clamp 26 and in FIG. 3 via line 55 to electrical clamp 27.

Electrical clamp 26 (FIGS. 1 and 2) or 27 (FIG. 3) also comprises any commercially available clamp means capable of forming a good electrical connection with the pipe, fitting or electrical bus bar to be polished. One preferred clamp 26 for securement to a pipe is manufactured by Bessey of West Germany and marketed under the name "Die Rohr-Gripzange". This particular clamp adjusts to accomodate pipes of the smallest diameter to pipes of approximately 4 inches in diameter. As shown, clamp 26 has two upper arms 29 which have engaging surfaces 33 shaped to conform to the outer surface of the pipe to be cleaned for enhanced electrical connection. Preferably, clamp 26 and line 54 are readily detachable from power source 24, e.g., through the use of a standard plug and socket arrangement, to allow for ready attachment of clamp 27 and line 55 to source 24. As shown in FIG. 3, clamp 27 is designed to more easily attach to a fitting to be polished.

Figure 4:
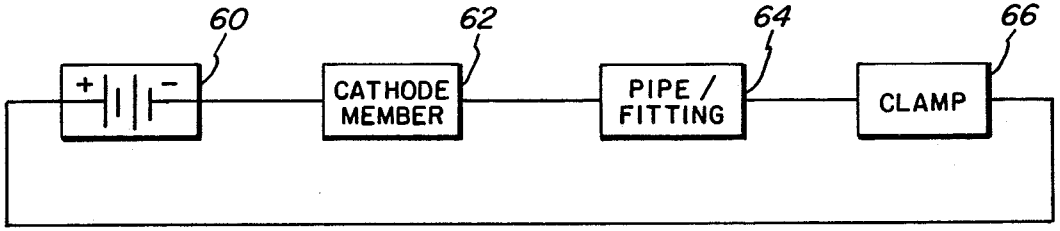
FIG. 4 is a block diagram of the electrical circuit attained by the apparatus and method of the present invention.

Referring to FIG. 2, in operation apparatus 10 can be used to polish the exterior surface of an end 36 of pipe 35 to be soldered. Specifically, the pipe end 36 to be cleaned is positioned within saddle-shaped free end 34 of column 20, and clamp 26 is secured to the pipe. Clamp 26 may be electrically connected to any point on the pipe. As shown in FIG. 4, connecting clamp 26 to the pipe (or clamp 27 to the fitting) completes an electrical circuit between supply 24, cathode member 16, the pipe/fitting, 35/44, and clamp 26/27, respectively. As shown in FIG. 3, the inner surface of fitting 44 is readily electrochemically cleaned by affixing clamp 27 to fitting 44 and lowering the fitting over peg-shaped second column 22. Subsequent polishing, the fixture should be rinsed in a container of water (not shown) to remove any excess electrolytic solution. Because of this "drag out" of solution, over time container 12 will need to be refilled with solution 14.

Lastly, it should be noted that an important benefit of the apparatus and method of the present invention is the tremendous savings in time resulting from its use in comparison with prior art fixture cleaning techniques. With this invention a plumbing or electrical fixture can be satisfactorily polished in 3 or 4 seconds.

It will be observed from the above that the present invention fully meets the objectives set forth. A novel apparatus and method are provided for quickly, safely and efficiently polishing telescoping surfaces of a pipe and fitting to be united in a solder joint and for polishing bus bars for improved electrical connections thereto.

Although one embodiment the apparatus and method of the present invention has been illustrated in the accompanying drawings and described in the foregoing detailed description, it will be understood that the invention is not limited to the particular embodiment described herein, but is capable of numerous rearrangements, modifications and substitutions without departing from the scope of the invention. As noted above, depending upon the type of fixture to be cleaned, either column 20 or column 22 may be sufficient by itself. Further, the apparatus and method of the present invention are equally applicable to cleaning any plumbing or electrical fixture manufactured of most any utilized metal or metal alloy, such as stainless alloys. Other changes will suggest themselves to those skilled in the art. The following claims are intended to encompass all such modifications.

I claim:

1. Apparatus for polishing a metallic plumbing fixture having a circular cross-section and an elongate metallic electrical fixture, said polishing apparatus comprising;

container means for retaining an electrolytic solution;

a cathode member positionable within said container means, said cathode member being at least partially immersed within the electrolytic solution retained within said container means when said member is positioned within the container means, said member being specially designed to accommodate a plumbing fixture having a circular cross-section and an elongate electrical fixture;

dc power supply means including a negative terminal and a positive terminal, said negative terminal being electrically connectable to said cathode member; and clamp means for forming an electrical connection with the fixture to be polished, said clamp means being electrically connected to the positive terminal of said power supply means such that when the fixture having said clamp means secured thereto is brought near said cathode member with said member positioned within the container means and electrically connected to the negative terminal of said power supply means, that portion of the fixture near said cathode member undergoes electropolishing.

2. The polishing apparatus of claim 1, wherein said cathode member has a base portion and a first column extending therefrom and said container means has at least one sidewall, and wherein said cathode member first column extends above said at least one container means sidewall.

3. The polishing apparatus of claim 2, wherein said cathode member first column is surrounded by wick means capable of drawing the electrolytic solution retained within said container means to the free end of said first column.

4. The polishing apparatus of claim 3, wherein the fixture to be polished comprises a pipe or elongate electrical fixture and the free end of said cathode member first column has a saddle-shaped configuration designed to receive said pipe or electrical fixture.

5. The polishing apparatus of claim 4, wherein said saddle-shaped configuration accommodates said pipe or electrical fixture to be polished in a substantially horizontal position.

6. The polishing apparatus of claim 1, wherein said container means, cathode member, dc power supply and clamp means are each readily portable.

7. Apparatus for polishing metallic plumbing and electrical fixtures, said polishing apparatus comprising:

container means for retaining an electrolytic solution, said container means having at least one sidewall;

a first contact member positionable within said container means, said first contact member having a base portion and a first column extending therefrom, said first contact member being at least partially immersed within the electrolytic solution retained within said container means, said first column being sized such that its free end extends above the electrolytic solution when said first contact member is positioned within said container means;

wick means surrounding said first column for drawing the electrolytic solution retained within said container means to the free end of said first column;

power supply means including a first terminal and a second terminal, said first terminal being electrically connectable to said first contact member; and a second contact member comprising clamp means for forming an electrical connection with a metallic fixture to be polished, said second contact member being electrically connected to said second terminal of the power supply means such that when the fixture having said second contact member secured thereto approaches said first column of said first contact member with said member positioned within said container means and electrically connected to said first terminal of the power supply means, that portion of said fixture near the first column is electropolished, whereby said wick means allows said fixture to be polished without being immersed within the electrolytic solution retained within said container means.

8. The polishing apparatus of claim 7 wherein the fixture to be polished comprises a copper or copper alloy pipe or fitting.

9. The polishing apparatus of claim 8, wherein said power supply means provides dc power and wherein said first terminal comprises a negative terminal of said power supply means, said second terminal comprises a positive terminal of said power supply means, said first contact member comprises a cathode member, and said second contact member comprises an anode member.

10. The polishing apparatus of claim 9, wherein the free end of said cathode member first column extends above said at least one sidewall of said container means.

11. The polishing apparatus of claim 9, wherein said container means has a partially open top and the free end of said first column of the cathode member extends therethrough.

12. The polishing apparatus of claim 9, wherein the free end of said cathode member first column is specially configured for receiving an end of pipe to be polished.

13. The polishing apparatus of claim 12, wherein the free end of said cathode member first column has a saddle-shaped configuration sized to receive the pipe end to be polished.

14. The polishing apparatus of claim 13, wherein said saddle-shaped configuration accommodates the pipe to be polished in a substantially horizontal position.

15. The polishing apparatus of claim 7, wherein said first contact member is manufactured of lead, and said apparatus further comprises a protective netting surrounding said first column of said first contact member for preventing the fixture being polished from directly engaging said first contact member.

16. The polishing apparatus of claim 15, wherein said wick means is located between said first column and said protective netting.

17. The polishing apparatus of claim 16, wherein said protective netting is manufactured of an arimide fiber material.

18. The polishing apparatus of claim 7, wherein said container means, said first and second contact members, and said power supply means are portable.

19. The polishing apparatus of claim 7, wherein said first contact member further includes a second column extending from said base portion, said second column being sized to be immersed within the electrolytic solution retained by the container means when said first contact member is positioned within the container means.

20. The polishing apparatus of claim 19, wherein said first contact member is manufactured of lead and said second column is peg shaped, and said apparatus further comprises a protective netting positioned about said first contact member second column such as to prevent the fixture being polished from directly engaging said second column.

21. The polishing apparatus of claim 20, wherein said first contact member is secured to said container means.

22. A method for polishing a metallic plumbing fixture having a circular cross-section and an elongate metallic electrical fixture, said polishing method comprising the steps of:

providing an electrochemically inert container with an electrolytic solution therein and a cathode member at least partially immersed within said solution, said cathode member having at least one column specially configured for receiving circular-shaped and elongate fixtures;

providing dc power supply means having a negative terminal and a positive terminal;

electrically connecting said negative power supply terminal to said cathode member;

electrically clamping the positive terminal of said power supply means to a metallic plumbing fixture having a circular cross-section or an elongate metallic electrical fixture to be polished; and moving said fixture to a position in near engagement with said at least one specially designed cathode member column such that said fixture is electropolished.

23. The polishing method of claim 22, further comprising the step of holding said fixture in near engagement with said cathode member for a sufficient period of time for that portion of the fixture adjacent said cathode member to become polished.

24. The polishing method of claim 23, further comprising the step of rotating the fixture in near engagement with said cathode member to facilitate polishing of said fixture.

* * * * *